US008723627B2

(12) United States Patent
Serpinet et al.

(10) Patent No.: US 8,723,627 B2
(45) Date of Patent: May 13, 2014

(54) ELECTRICAL CUT-OFF DEVICE WITH HIGH ELECTRODYNAMIC RESISTANCE

(75) Inventors: Marc Serpinet, Sundhouse (FR); Yves Trichard, Colmar (FR); Arnaud Marchal, Ebersheim (FR)

(73) Assignee: Socomec, S.A., Benfeld (FR)

( * ) Notice: Subject to any disclaimer, the term of this patent is extended or adjusted under 35 U.S.C. 154(b) by 0 days.

(21) Appl. No.: 13/598,818

(22) Filed: Aug. 30, 2012

(65) Prior Publication Data

US 2013/0056340 A1 Mar. 7, 2013

(30) Foreign Application Priority Data

Sep. 1, 2011 (FR) ..... 11 57712

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 9/30*** | (2006.01) |
| ***H01H 67/02*** | (2006.01) |

(52) U.S. Cl.
USPC ..... 335/131; 335/16; 335/201

(58) Field of Classification Search
USPC ..... 335/147, 16, 201, 131; 218/22
See application file for complete search history.

(56) References Cited

U.S. PATENT DOCUMENTS

| | | | | |
|---|---|---|---|---|
| 2,356,040 | A * | 8/1944 | Ellis et al. | 218/39 |
| 3,319,199 | A | 5/1967 | Bauer | |
| 3,483,343 | A * | 12/1969 | Heft | 218/22 |
| 3,515,829 | A * | 6/1970 | Hurtle et al. | 218/31 |
| 3,575,680 | A * | 4/1971 | Beaudoin et al. | 335/201 |
| 4,611,188 | A * | 9/1986 | Murai et al. | 335/16 |
| 4,633,207 | A * | 12/1986 | McClellan et al. | 335/16 |
| 5,130,504 | A * | 7/1992 | Moldovan et al. | 218/40 |
| 5,138,122 | A * | 8/1992 | Moldovan et al. | 218/22 |
| 2003/0038695 | A1 | 2/2003 | Kramer | |
| 2010/0026427 | A1 | 2/2010 | Moeller et al. | |

FOREIGN PATENT DOCUMENTS

| | | |
|---|---|---|
| BE | 661 103 | 7/1965 |
| DE | 741 311 | 11/1943 |
| EP | 0 199 668 A2 | 10/1986 |
| EP | 0 473 014 A2 | 3/1992 |
| EP | 1 026 710 A2 | 8/2000 |
| EP | 1 085 610 A1 | 3/2001 |
| FR | 2 188 292 | 1/1974 |

(Continued)

OTHER PUBLICATIONS

French Search Report Corresponding to FR 11/57712.

(Continued)

*Primary Examiner* — Alexander Talpalatski
(74) *Attorney, Agent, or Firm* — Davis & Bujold, PLLC; Michael J. Bujold

(57) ABSTRACT

An electrical cut-off device (1) with high electrodynamic resistance in which the fixed contacts (4) and the moving contact (5) are arranged according to an architecture forming a current loop so that the Laplace electromagnetic forces, called compensation forces (Fc), generated by the circulation of the current (I) in the current loop, are oriented in a direction flowing from the inside toward the outside of the current loop, and in which the actuator mechanism (6) is arranged for moving the moving contact (5) inside of the current loop, from its switched-off position to its switched-on position in a direction (Fd) that is identical to the direction of the compensation forces (Fc).

10 Claims, 6 Drawing Sheets

(56) References Cited

FOREIGN PATENT DOCUMENTS

| | | | |
|---|---|---|---|
| FR | 2 383 513 | A1 | 6/1978 |
| FR | 2 524 195 | A1 | 3/1982 |
| FR | 2 516 699 | A1 | 5/1983 |
| FR | 2 638 017 | A1 | 4/1990 |
| FR | 2 756 412 | A1 | 5/1998 |
| FR | 2818434 | A1 | 6/2002 |
| FR | 2 891 395 | A1 | 3/2007 |
| GB | 2 096 396 | A | 10/1982 |
| GB | 2 384 626 | A | 7/2003 |
| WO | 2006/137687 | A1 | 12/2006 |
| WO | 2007/036624 | A1 | 4/2007 |

OTHER PUBLICATIONS

French Search Report Corresponding to FR11/57713.
French Search Report Corresponding to FR11/57714.

* cited by examiner

ELECTRICAL CUT-OFF DEVICE WITH HIGH ELECTRODYNAMIC RESISTANCE

This application claims priority from French patent application serial no. 11/57712 filed Sep. 1, 2011.

FIELD OF THE INVENTION

The present invention relates to an electrical cut-off device with high electrodynamic resistance provided with a control module associated with at least one cut-off module corresponding to a phase of an electrical network, this cut-off module including at least one moving contact associated with at least one pair of fixed contacts, said moving contact being coupled with an actuator mechanism controlled by said control module so as to be moved between at least one switched-off position in which the moving contact is distant from the fixed contacts and the electrical circuit is open, and a switched-on position in which the moving contact is resting on the fixed contacts and the electrical circuit is closed.

BACKGROUND OF THE INVENTION

An example of this type of cut-off device is described in publications FR 2 818 434 and FR 2 891 395 by the same applicant and relates in particular to switches, fuse switches, commutators, reversing switches, circuit breakers or similar appliances.

When two electric conductors are resting on each other, they form a contact point or area that allows the electrical current to transit from one conductor to the other. The passage of the electrical current produces a heating at the contact point that depends on the nature of the conductors, the pressure on the conductors and the intensity of the current passing through the contact point. Forces called repulsion forces (Fr) that tend to move the two conductors away from each other appear in the same time. To overcome these disadvantages, the electrical cut-off devices are equipped with return means arranged to exert a pressing effort (Fp) on at least one of the conductors and press it on the other. The limit of the electrodynamic resistance is reached when the repulsion effort (Fr) becomes higher than the pressing effort (Fp) or when the heating generated by the current at the contact point causes the melting of the metal, which leads to the welding of the two conductors when cooling down.

To meet the need of electrodynamic resistance in cut-off devices with intensity ratings lower than 100 A, one uses the pressing effort Fp of a return spring. The electrodynamic resistance remains low. The increase of the pressing effort Fp, which is proportional to I2, reaches its limit in the implementation of the actuator mechanism of the moving contacts.

In cut-off devices with a rated intensity above 100 A, one uses the combination of the pressing effort Fp of a return spring and of an effort called compensation effort (Fc) generated by the current itself. In fact, the current flow lines induce electromagnetic forces called Laplace forces in the conductors. In this type of devices, the two fixed contacts are bridged by means of two parallel and opposite moving contacts. The two parallel moving contacts are crossed each by half of the current that generates Laplace forces or compensation forces Fc proportional to the product of the currents flowing through each contact. These compensation forces Fc oppose to the repulsion forces Fr and tend to bring the two moving contacts closer, thus to press them on the fixed contacts. In this case, the electromagnetic resistance is high. Yet these moving contacts are generally placed in closed position on the fixed contacts by sliding according to a displacement force Fd perpendicular to the forces Fp and Fc. A chamfer lead is then provided to facilitate the insertion of the moving contacts between the fixed contacts and guarantee a wear stroke as well as a sufficient contact pressure. During a short-circuit, the compensation forces Fc appear as soon as the contacts touch the chamfer lead and generate additional forces to overcome in order to achieve a complete closing of the contacts. The closing power of a cut-off device is limited by these interfering forces if their level becomes so high that they stop the displacement of the moving contacts before the complete passage through the chamfer lead. This leads to the destruction of the contacts. To increase the electrodynamic resistance level, the energy of the actuator mechanism, and thus of the displacement effort Fd, must be increased. The state of the art is a compromise between the electrodynamic resistance level and the actuation effort of the moving contacts. On the other hand, the state of the art shows that beyond a current of 10 kA passing through the contact point, the resulting contact pressure (Fres.=Fp+Fc−Fr) must be strongly increased to avoid the phenomena of local melting of the contact, generally followed by the welding of both contacts. The existing devices show mediocre electrical endurance abilities. In fact, the electric arc that appears in the area of the chamfer lead modifies quickly the characteristics of this chamfer lead and increases strongly the effort Fd required for achieving a stable closed position.

Publications U.S. Pat. No. 2,356,040 and EP 0 473 014 A2 illustrate cut-off devices equipped with electric arc splitting chambers. In these publications, the moving contact is moved outside of a current loop defined by the arrangement of the fixed contacts and of the moving contact. In fact, the compensation forces oppose to the displacement of the moving contact when switching on, instead of accompanying it. Therefore, these publications do not bring a satisfying solution to the problem posed.

SUMMARY OF THE INVENTION

The present invention aims to remedy these disadvantages by offering an electrical cut-off device whose cut-off modules are configured according to a new internal architecture, in which the compensation forces Fc do not oppose to the displacement Fd of the moving contacts but, in the contrary, accompany it in the contacts closing direction, the resulting contact pressure is sufficient to avoid the local contact melting and welding problems, and the negative effects of the electric arc during closing and opening are reduced or even suppressed, so that the cut-off of the current remains possible whatever its intensity (from 0 to 10×rated I) and the type of current (direct or alternating).

To that purpose, the invention relates to an electrical cut-off device of the kind indicated in the preamble, characterized in that the fixed contacts and the moving contact are arranged according to an architecture forming a current loop having an omega shape that is symmetrical with respect to a centerline so that the Laplace electromagnetic forces, called compensation forces, generated by the circulation of the current in said current loop, when said cut-off module is in the switched-on position, are oriented in a direction going from the inside towards the outside of the current loop, and in that said moving contact is arranged to move inside of the current loop, from its switched-off position to its switched-on position, in a direction that is identical to the direction of said compensation forces, that is to say in a direction going from the inside towards the outside of the current loop, while the direction of the compensation forces and of the displacement forces of said moving contact is merged with the centerline of said current loop.

The fixed contacts and the moving contact comprise advantageously respectively contact areas through which the current flows when said cut-off module is in the switched-on position, while said contact areas can be included in a plane perpendicular to said centerline or can be included each in a plane inclined with respect to this centerline. Said plane is preferably inclined with respect to said centerline according to an angle substantially equal to 45°.

The moving contact may include a central boss that, when said cut-off module is in its switched-on position, extends in the free space between said fixed contacts outside of said current loop and is arranged so as to displace the electric arc generated by the current when opening said electrical circuit in the direction of said compensation forces.

It may also be associated with an insulating shield that, when said cut-off module is in its switched-on position, extends in the free space between said fixed contacts outside of said current loop and is arranged so as to stretch the electric arc generated by the current when opening said electrical circuit.

Preferably, said cut-off module is completed with splitting chambers disposed outside of said current loop and arranged to receive and extinguish the electric arc when it has left said moving contact.

BRIEF DESCRIPTION OF THE DRAWINGS

The present invention and its advantages will be better revealed in the following description of an embodiment given as a non limiting example, in reference to the drawings in appendix, in which.

DETAILED DESCRIPTION OF THE PREFERRED EMBODIMENTS

Figure 1:
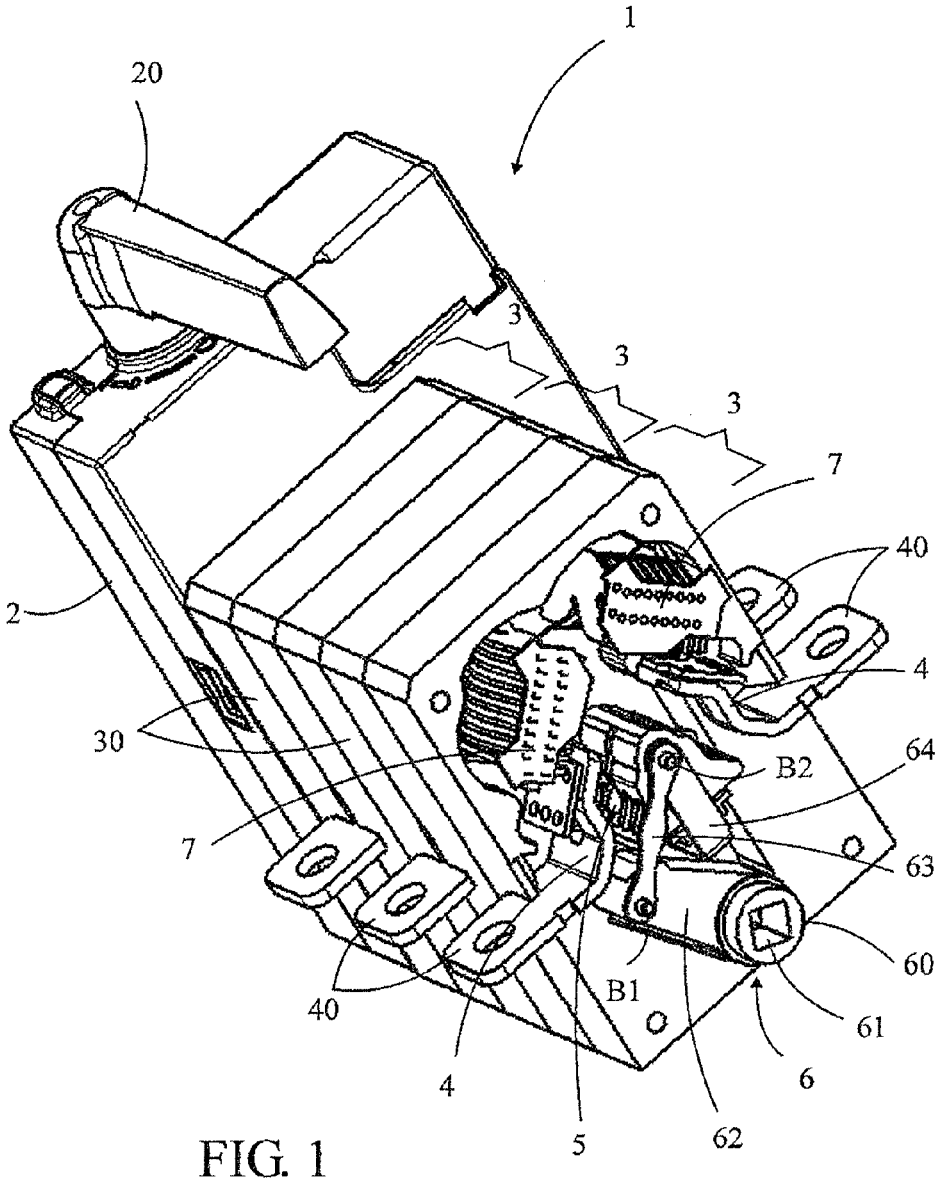
FIG. 1 is a perspective view of an electrical cut-off device according to the invention comprising a control module associated with three cut-off modules, in which the last cut-off module is open.

Referring to FIG. 1, the electrical cut-off device 1 object of the invention is usually made of a control module 2 associated with one or several cut-off modules 3 corresponding each to a phase of an electrical network. In the illustrated example, the device 1 comprises three cut-off modules 3. Each cut-off module 3 comprises in a known manner an insulating housing 30 inside of which at least two fixed contacts 4 are seated, extending outside of said housing by means of connection terminals 40, as well as at least one moving contact 5 coupled with an actuator mechanism 6 controlled by the control module 2 in order to be moved between at least one switched-off position in which it is distant from the fixed contacts and the electrical circuit is open, and a switched-on position in which it is resting on the fixed contacts and the electrical circuit is closed. The control module 2 may be actuated manually by means of a handle 20 and/or automatically by means of a motorization (not represented). In the represented example, the cut-off device 1 comprises splitting chambers 7 located above the fixed contacts 4 and the moving contact 5 in order to capture and extinguish the electric arc generated by the current at every status change of said device.

This cut-off device 1 must be able to establish and cut off currents I called normal or fault currents having a value from 0 to 10 In, In being the value of the rated current that can flow continuously through the device. This device must also be able to establish and if necessary cut off short-circuit currents whose value can reach 100 to 300 times the rated current In. By its design described in detail hereafter, the cut-off device 1 according to the invention thus allows:

- minimizing the energy required for the displacement of the moving contacts 5 even under very severe conditions, in particular in case of a short-circuit,
- achieving a very high electrical endurance (repeated opening and closing cycles), and
- surpassing the electrodynamic characteristics of the state of the art in a reduced volume and with a reduced control energy.

Figure 2:
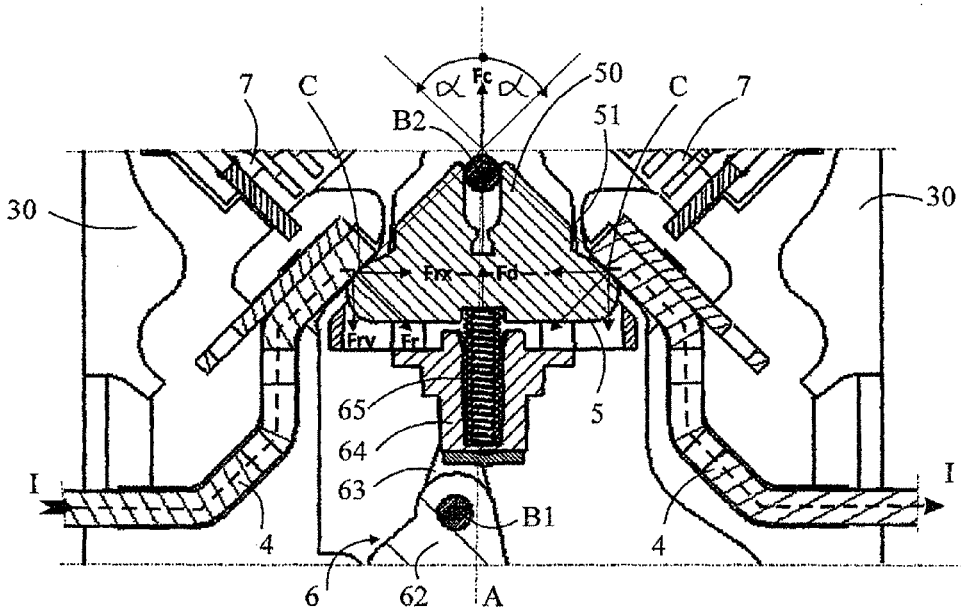
FIG. 2 is an enlarged partial cross-sectional view of one of the cut-off modules of the device of FIG. 1, showing the internal architecture of the fixed and moving contacts with the distribution of the forces at play.
Figure 3:
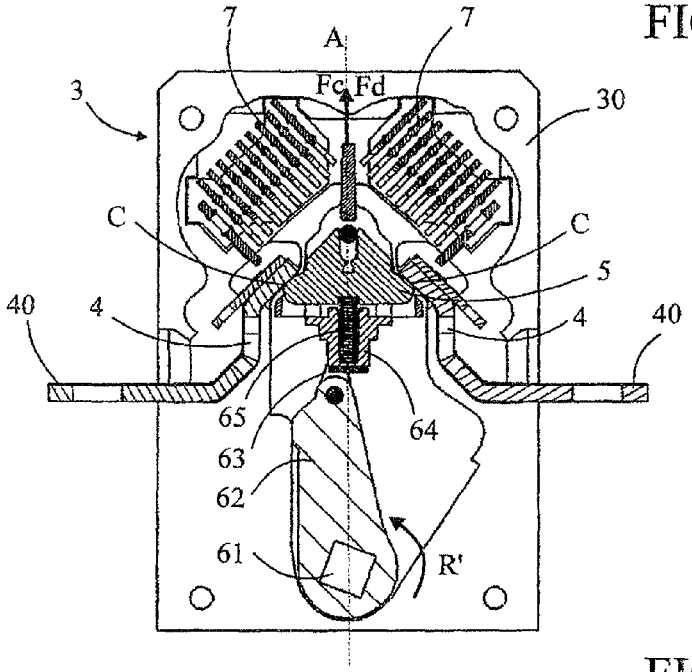
FIG. 3 is a cross-sectional view of the cut-off module of FIG. 2 in switched-on position.

To that purpose, the cut-off device 1 according to the invention distinguishes itself from the state of the art by the internal architecture of its cut-off modules 3, as shown more in detail in FIGS. 2 and 3. The fixed contacts 4 and the moving contact 5 are arranged in order to form a current loop so that the Laplace electromagnetic forces, called compensation forces Fc, generated by the circulation of the current I in the current loop (represented in dashed lines in FIG. 2) are oriented in a direction going from the inside towards the outside of the current loop, which results in pressing the moving contact 5 on the fixed contacts 4 in the switched-on position. Furthermore, the actuator mechanism 6 is arranged so as to move the moving contact 5 from its switched-off position to its switched-on position, inside of said current loop, in a direction Fd identical to the direction of the compensation forces Fc. This way, the compensation forces Fc generated by the current I, which are proportional to the square of the current I, are added, and do not oppose, to the displacement forces Fd of the moving contact 5 in the direction of the closing of the moving contact 5 on the fixed contacts 4. This architecture allows limiting the energy required for moving the moving contacts 5, and thus reducing the size of the control module 2, and reducing the manufacturing costs. This architecture also allows, as explained below, to facilitate and accelerate the displacement of the electric arc that is created when opening the electrical circuit towards the splitting chambers 7.

Figure 3A:
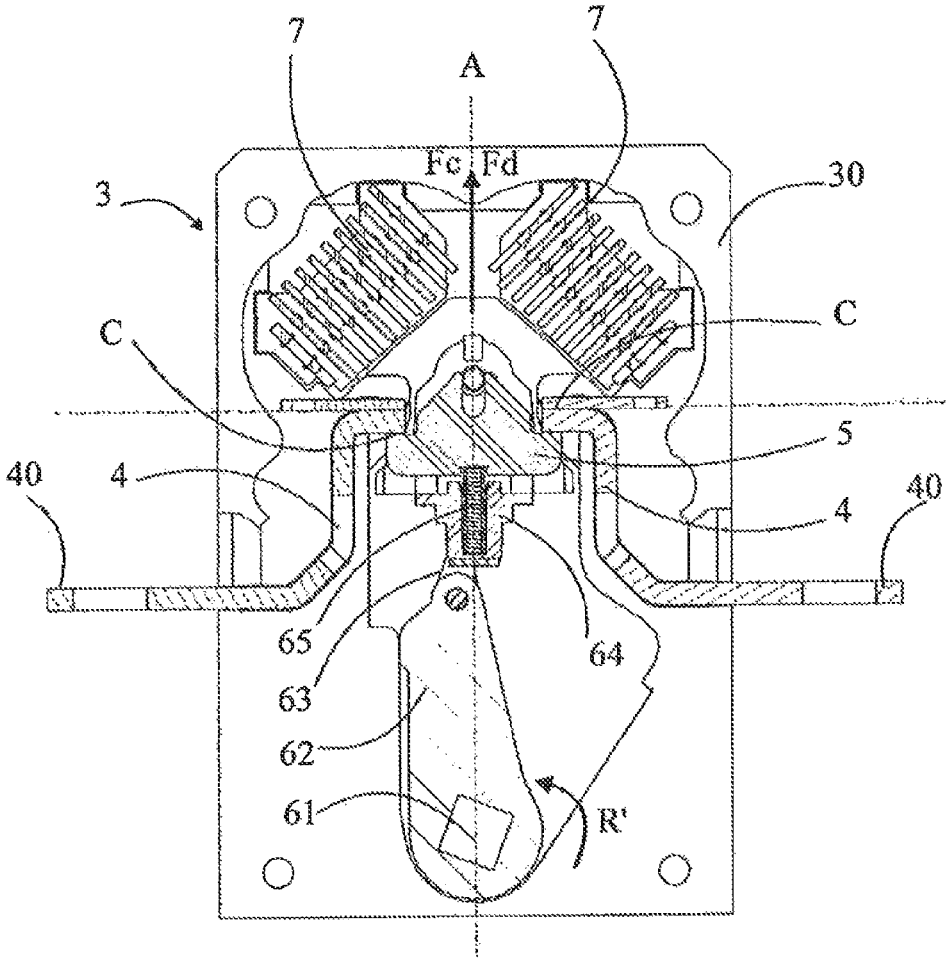
FIG. 3A is a cross-sectional view of the cut-off module in the switched-on position in which the contact areas are located in a plane perpendicular to the centerline.
Figure 4A:
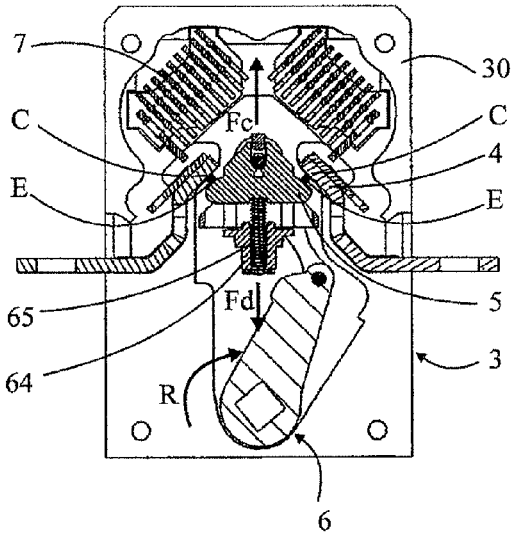
FIGS. 4A to 4F are views of the cut-off module of FIG. 3 in various opening positions up to the switched-off position, showing the displacement of the electric arc.
Figure 4B:
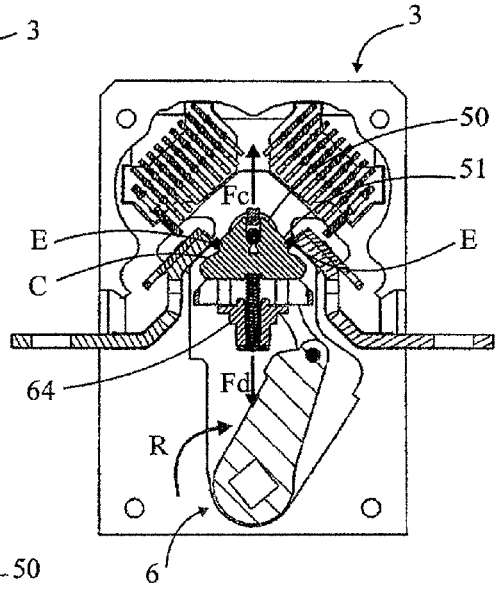
Figure 4C:
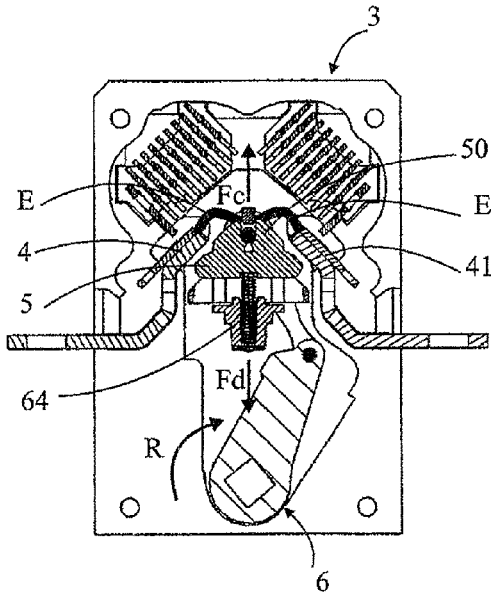
Figure 4D:
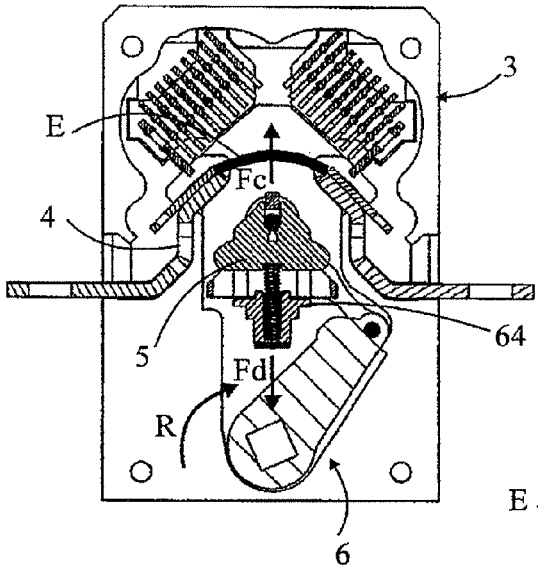
Figure 4E:
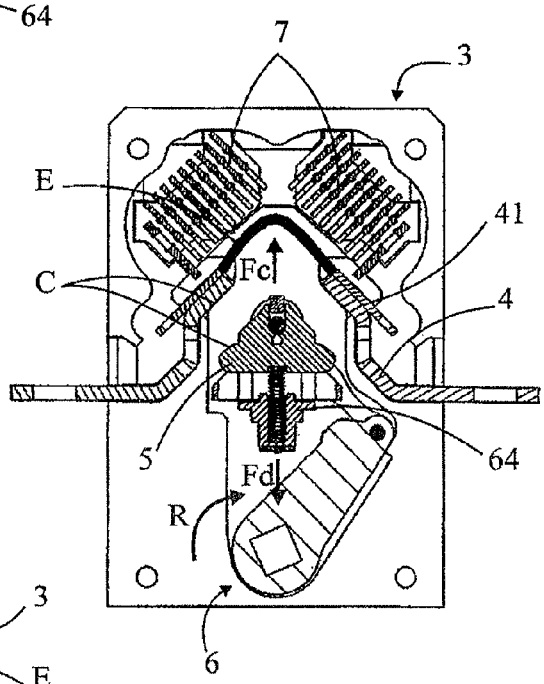
Figure 4F:
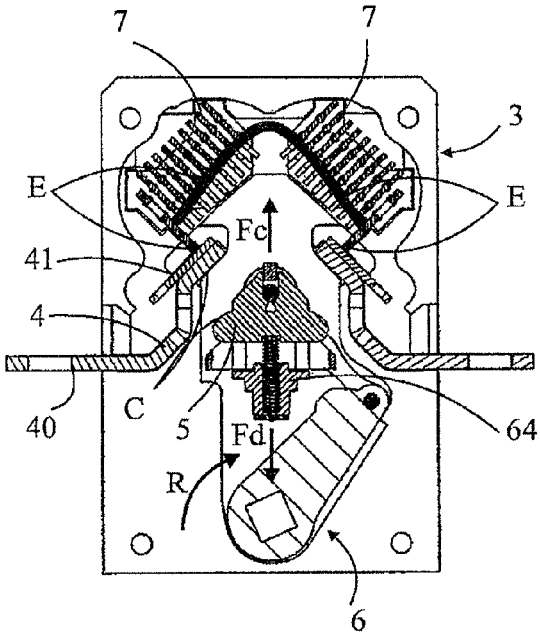

In the represented example, the current loop has an omega-shaped geometry, which is symmetrical with respect to a centerline A merged with the displacement axis Ed of the moving contact 5 and at the point of application of the compensation forces Fc. The conductive parts that form the fixed contacts 4 are rigidly attached to the housing 30, they are bent substantially with an S-shape, arranged in opposition and separated by a free central space. The conductive part that forms the moving contact 5 has a width larger than the free space between the two fixed contacts 4 in order, in the switched-on position, to be pressed against the fixed contacts 4. Each of these conductive parts has a contact area C located in a plane inclined by an angle substantially equal to 45° with respect to the centerline A. This example is not restrictive, since the contact areas C can be comprised in a plane inclined with respect to the centerline A by an angle that can be comprised between 0 and 90', the value 0' being excluded. The interest of an angle of 45° is that it allows minimizing the repulsion forces Er linked with the passage of the current I in the contact areas C and opposing to the compensation forces Fc. These repulsion forces Fr are reduced to their Fry component, that is to say a value of 0.707 times the value of Fr. This architecture thus allows reducing the dimensions of the current loop, and therefore the volume of copper necessary, and reducing the manufacturing costs. On the other hand, the stroke of the moving contacts 5 must be multiplied by 1.414 if the contact areas C are at 90° with respect to the centerline A, as shown in FIG. 3A.

In the represented example, the actuator mechanism 6 of the moving contacts 5 comprises a drive shaft 60 linked in rotation with the handle 20 by means of a (non visible) angle transmission and/or controlled by a second (non represented) element fitted in the square bore 61. A system converting the rotary movement of drive shaft 60 into a translation movement allows moving a carriage 64 carrying the moving contact 5 along centerline A. This movement conversion system comprises a couple of jointed rods 62, 63, but any other equivalent means is conceivable. The first rod 62 is fixed to the drive shaft 60 and coupled in rotation with the second rod 63 by means of a first joint B1. The second rod 63 is coupled in rotation with the carriage 64 by means of a second joint B2. The carriage 64 is guided in translation with respect to housing 30 by means of rails, ribs or any other equivalent means. A return means 65 is inserted between the carriage 64 and the moving contact 5 to exert a determined pressing effort Fp on the moving contact 5 when it is pressed against the fixed contacts 4. This pressing effort Fp adds to the compensation forces Fc generated by current I.

In the represented example, the moving contact 5 comprises in its upper section a central boss 50 that gives to said moving contact 5 a substantially triangular shape, symmetrical with respect to centerline A. Of course, any other shape may be suitable. When the cut-off module 3 is in its switched-on position, the boss 50 extends in the free space between the fixed contacts 4 outside of the current loop. This boss 50 is connected with the contact areas C through a shoulder 51 that forms a nose, on which the electric arc generated by the current when opening the electrical circuit positions itself, releasing thus quickly the contact areas C. This boss 50 then defines a slope that rises in the direction of the compensation forces Fc and accompanies the displacement of said electric arc, which is pushed by these compensation forces Fc towards the splitting chambers 7.

FIGS. 4A to 4F illustrate each step of the displacement of the electric arc when opening the electrical circuit, that is to say from the switched-on position up to the switched-off position of the cut-off module. In FIG. 3, the cut-off module 3 is in its switched-on position, the electrical circuit is closed. In this position, the moving contact 5 is pressed against the fixed contacts 4 by the return means 65 compressed by the relative movement of the carriage 64 in the direction Fd with respect to the moving contact 5, which is stopped in its stroke by the fixed contacts 4. The drive shaft 60 has been turned in the counterclockwise direction R' until reaching the maximum stroke of the carriage 64. The joint B1 of the rods 62, 63 has passed on the other side of the centerline A and contributes to stabilize the switched-on position of the cut-off module 3. The electrical circuit is opened by turning the drive shaft 60 in the clockwise direction R, which generates the down movement of the carriage 64 and releases the return means 65, allowing the moving contact 5 to leave the fixed contacts 4.

As soon as the electrical circuit is open (see FIG. 4A), an electric arc E appears in the contact areas C between the fixed contacts 4 and the moving contact 5. Then, very quickly (see FIG. 4B), as soon as the distance between the contact areas C becomes larger than the distance between the nose formed by the shoulder 51 of the moving contact 5 and the end of the fixed contacts 4, the electric arc E jumps between this shoulder 51 and the end of the fixed contacts 4, sparing the contact areas C. It then continues its displacement (see FIG. 4C) towards the top of the boss 50 of the moving contact 5 and turns around the end of the fixed contacts 4 to establish itself on spark arrestors 41 associated with these fixed contacts 4. The electric arc E extends until it forms one single electric arc that extends between the two spark arrestors 41 (see FIG. 4D). The compensation forces Fc send it inside the splitting chambers 7 (see FIGS. 4E and 4F), where it extinguishes after having been lengthened, split and cooled down.

Figure 5A:
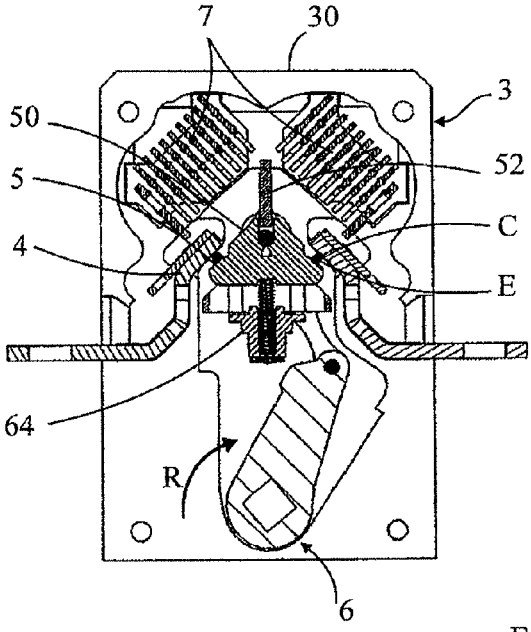
FIGS. 5A to 5C are views similar to FIGS. 4A, 4D and 4F of a cut-off module according to an embodiment variant of the invention.
Figure 5B:
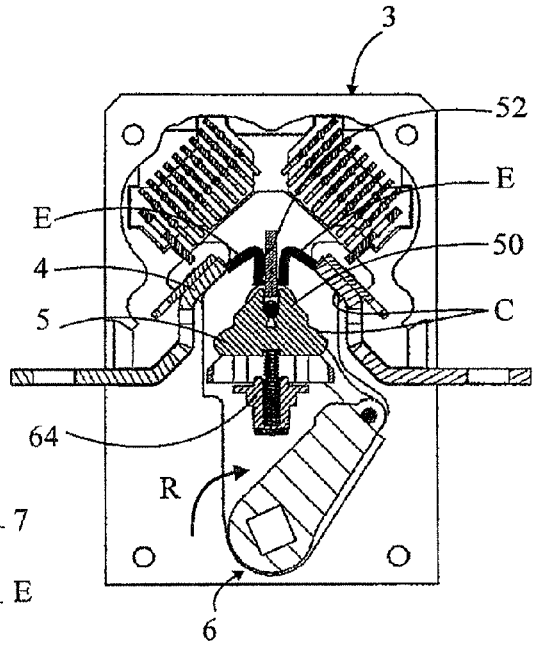
Figure 5C:
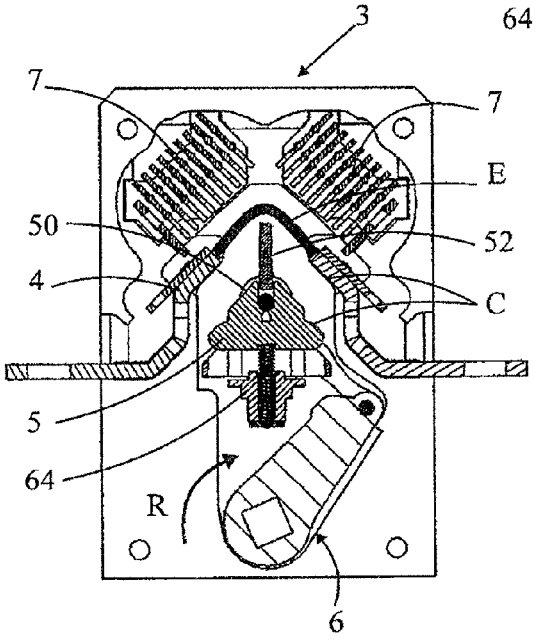

When cutting-off low direct currents, typically with a value of about 0.1 In, the Laplace forces or compensation forces Fc are not sufficient to send the electric arc inside the splitting chambers 7. One provides in this case an insulating shield 52, located on the boss 50 of the moving contact 5, which avoids the formation of the single electric arc. This embodiment variant is illustrated by FIGS. 5A to 5C. The moving contact 5 comprises, as an extension of its boss 50, an insulating shield 52 centered on the centerline A. The displacement of the electric arc when opening the electrical circuit, in the case of low direct currents, is illustrated in FIGS. 5A to 5C, which represent the three main steps.

As soon as the electrical circuit opens (see FIG. 5A), an electric arc E appears in the contact areas C between the fixed contacts 4 and the moving contact 5. It then continues its displacement (see FIG. 5B) towards the top of the boss 50 of the moving contact 5 and turns around the end of the fixed contacts 4 to establish itself on spark arrestors 41 associated with these fixed contacts 4. The electric arc E extends on both sides of the insulating shield 52. If the current is low, below some 0.1 In, the presence of the insulating shield 52 prevents the formation of the single electric arc above said shield. The two elementary arcs E remain confined on each side of the insulating shield 52, where they are stretched and cooled down locally until their extinction. If the current is higher than In, the compensation forces Fc contribute to lengthen the electric arc beyond the insulating shield 52 to form only one electric arc (see FIG. 5C) that will be sent inside the splitting chambers 7 to extinguish after having been lengthened, split and cooled down.

This description shows clearly that the invention allows reaching the goals defined, in particular to surpass the electrodynamic resistance and closing capacity limits known from the state of the art, while minimizing the energy required for the actuator mechanism 6. Its management of the electric arc allows the invention to reach high current cut-off abilities with a very high electrical endurance level.

The present invention is not restricted to the examples of embodiment described, but extends to any modification and variant which is obvious to a person skilled in the art while remaining within the scope of the protection defined in the attached claims.

The invention claimed is:

1. An electrical cut-off device (1) with high electrodynamic resistance provided with a control module (2) associated with at least one cut-off module (3) corresponding to a phase of an electrical network, the cut-off module comprising:

at least two fixed contacts (4) and at least one moving contact (5), the moving contact (5) being coupled with an actuator mechanism (6) controlled by the control module (2) so as to be movable between at least one switched-off position, in which the moving contact is spaced from the fixed contacts and the electrical circuit is open, and a switched-on position, in which the moving contact is resting on the fixed contacts and the electrical circuit is closed, wherein the fixed contacts (4) and the moving contact (5) are arranged according to an architecture forming a current loop which has a symmetrical omega shape with respect to a centerline (A) so that compensation forces (Fc) (Laplace electromagnetic forces) generated by the circulation of the current (I) in the current loop, when the cut-off module (3) is in the switched-on position, are oriented in a direction flowing from an inside toward an outside of the current loop, and the moving contact (5) is arranged to move inside of the current loop, from its switched-off position to its switched-on position, in a direction of a displacement forces (Fd) that is identical to the direction of the compensation forces (Fc) which is in a direction from the inside toward the outside of the current loop, while the direction of the compensation forces (Fc) and of the displacement forces (Fd) of the moving contact (5) are merged at the centerline (A) of the current loop.

2. The device according to claim 1, wherein the fixed contacts (4) and the moving contact (5) comprise respectively contact areas (C) through which the current flows when the cut-off module (3) is in the switched-on position, and the contact areas (C) are located in a plane perpendicular to the centerline (A).

3. The device according to claim 1, wherein the fixed contacts (4) and the moving contact (5) comprise respectively contact areas (C) through which the current flows when the cut-off module (3) is in the switched-on position, and the contact areas (C) are each located in a plane inclined with respect to the centerline (A).

4. The device according to claim 3, wherein the plane is inclined, with respect to the centerline (A), at an angle ($\alpha$) substantially equal to 45°.

5. The device according to claim 1, wherein the moving contact (5) includes a central boss (50) that, when the cut-off module (3) is in its switched-on position, extends in a free space between the fixed contacts (4), outside the current loop, and is arranged so as to displace an electric arc generated by the current when opening the electrical circuit in the direction of the compensation forces (Fc).

6. The device according to claim 1, wherein the moving contact (5) is associated with an insulating shield (52) that, when the cut-off module (3) is in its switched-on position, extends in a free space between the fixed contacts (4) outside the current loop and is arranged so as to stretch the electric arc generated by the current when opening the electrical circuit.

7. The device according to claim 5, wherein the cut-off module (3) comprises splitting chambers (7) disposed outside of the current loop and arranged to receive and extinguish the electric arc when the cut-off module (3) has left the moving contact (5).

8. The device according to claim 1, wherein the fixed contacts (4) and the moving contact (5) are arranged, according to an architecture, so that the compensation forces (Fc) (Laplace electromagnetic forces) generated by the circulation of the current (I) in the current loop, when the cut-off module (3) is in the switched-on position, are oriented in a direction away from the moving contact (5).

9. The device according to claim 6, wherein the fixed contacts (4) and the moving contact (5) are arranged, according to an architecture, so that the compensation forces (Fc) (Laplace electromagnetic forces) generated by the circulation of the current (I) in the current loop, when the cut-off module (3) is in the switched-on position, are oriented in a direction away from and toward the insulating shield (52).

10. The device according to claim 6, wherein the insulated screen (52) is mounted on the movable contact (5).

* * * * *